US006655607B2

(12) United States Patent
Vazquez

(10) Patent No.: US 6,655,607 B2
(45) Date of Patent: Dec. 2, 2003

(54) SPRAY CAN ADAPTOR

(76) Inventor: Eduardo Vazquez, 2005 San Souci Blvd., #307, North Miami, FL (US) 33181

( * ) Notice: Subject to any disclaimer, the term of this patent is extended or adjusted under 35 U.S.C. 154(b) by 47 days.

(21) Appl. No.: 09/821,896

(22) Filed: Mar. 30, 2001

(65) Prior Publication Data

US 2001/0035466 A1 Nov. 1, 2001

Related U.S. Application Data

(60) Provisional application No. 60/195,029, filed on Apr. 6, 2000.

(51) Int. Cl.[7] ..... B05B 1/28; B05B 1/30; A62C 13/62; A62C 11/00

(52) U.S. Cl. ..... 239/288; 239/302; 239/331; 239/569

(58) Field of Search ..... 239/288, 302, 239/331, 375, 378, 569; 222/402.1, 390, 402, 402.15, 174, 192; 128/200.23

(56) References Cited

U.S. PATENT DOCUMENTS 3,610,475 A * 10/1971 Gach ..... 222/182
3,642,179 A * 2/1972 Micallef ..... 222/402.12
3,716,195 A * 2/1973 Silva ..... 239/375
3,734,357 A * 5/1973 Batistelli et al. ..... 222/323
3,791,551 A * 2/1974 Madeira ..... 220/787
3,828,982 A * 8/1974 Steigerwald ..... 222/153.11
3,876,113 A * 4/1975 Trotta ..... 222/182
4,040,543 A * 8/1977 Guillen ..... 222/473
5,307,959 A * 5/1994 Bedore et al. ..... 222/174
5,921,439 A * 7/1999 Losenno et al. ..... 222/95
6,109,484 A * 8/2000 Sueoka et al. ..... 222/390
6,299,032 B1 * 10/2001 Hamilton ..... 222/402.15
6,398,082 B2 * 6/2002 Clark et al. ..... 222/402.11

* cited by examiner

*Primary Examiner*—Davis D Hwu
(74) *Attorney, Agent, or Firm*—Robert M. Downey, PA

(57) ABSTRACT

An adaptor for use on a spray can which is normally operable by pushing down on a valve button with one's finger to open a valve and release pressurized contents in a sprayed pattern from a nozzle on the valve button. The adaptor releasably attaches to the top of the spray can and includes an actuator mechanism for holding the depressible valve button down in the open position, thereby allowing the pressurized contents of the can to be released from the nozzle without the use of the operator's finger. The actuator mechanism is operable between an on position, to hold the valve button down, and an off position to release the valve button in order to close the spray can valve when it is desired to interrupt spraying.

18 Claims, 2 Drawing Sheets

SPRAY CAN ADAPTOR

This application claims the benefit of Provisional Ser. No. 60/195,029 filed Apr. 6, 2000.

BACKGROUND OF THE INVENTION

1. Field of the Invention

The present invention is directed to an adaptor device for use with handheld spray cans and, more particularly, to an adaptor for releasable attachment to a spray can and including an actuator mechanism for holding a depressible valve button of the spray can in the down position, thereby allowing the contents of the can to be released through a nozzle without requiring the user to hold the depressible valve button down with his/her finger.

2. Discussion of the Related Art

Spray cans containing products such as paint, rust inhibitors, lubricants, and cleaners, to name a few, are well known in the art. Specifically, spray cans of this nature include a depressible valve button fitted to a hollow tube extending from the top of the can. The hollow tube communicates with a valve mechanism within the can. Upon depressing the valve button, the contents are released through the tube and out from a nozzle built into the valve button, with the assistance of a gas propellant. In some instances, only a quick shot of the contents is required to be released, whereupon use of one's index finger to depress the valve button is most convenient. Other times, a substantial amount of the contents of the can needs to be released in a continuous spraying action. For example, when painting a large surface area, it may be necessary to use most or all of the contents within the paint spray can. In this instance, the user is required to hold the valve button down with his/her index finger for a considerable length of time. For many individuals, this causes discomfort, and sometimes pain to the index finger and joints of the hand. Also, during the prolonged spraying action, the contents being released from the nozzle inevitably contact the tip of the index finger, causing discoloration and possible irritation. Furthermore, the discomfort caused by the prolonged application of pressure on the valve button, using one's finger, may be distracting to the user. This distraction can cause uneven application of paint, or other substances, to the surface being treated.

Accordingly, in view of the foregoing problems associated with the need to use one's finger to depress the valve button on spray cans, there remains an urgent need in the industry an adaptor which releasably attaches to existing spray cans, wherein the adaptor is structured to hold the valve button of the spray can in the depressed position, thereby allowing the contents to be released without use of one's finger to maintain downward pressure on the valve button.

SUMMARY OF THE INVENTION

The present invention is directed to an adaptor for a handheld spray canister of the type having a depressible valve button on the top of the canister for actuating a valve to release pressurized contents of the canister from a nozzle in the button. The adaptor includes a cylindrical side wall surrounding a hollow interior, a top wall, and an open bottom. The open bottom is sized and configured for releasable attachment to a top annular rim on the spray canister so that the depressible valve button of the spray canister is surrounded by the adaptor. An opening formed in the cylindrical side wall aligns with the spray nozzle of the valve button. An elongate actuator member is threadably received through the top wall of the adaptor so that a proximal end is maintained above the top wall and a distal end is positioned and disposed within the hollow interior of the adaptor in alignment with the valve button. Threaded advancement of the actuator member downwardly into the hollow interior of the adaptor, by rotating a knob on the proximal end, causes the distal end of the actuator member to apply a downward force on the valve button, thereby opening the canister valve and releasing the pressurized contents from the nozzle and through the window of the adaptor. Upward retraction of the actuator from the adaptor, by counter-rotating the knob, releases pressure from the valve button to thereby close the canister valve and interrupt spraying.

OBJECTS AND ADVANTAGES OF THE INVENTION

With the foregoing in mind, it is a primary object of the present invention to provide an adaptor for existing spray cans of the type commonly known for applying paint, rust inhibitors, lubricants, cleaning products, and the like, to a surface, wherein the adaptor is specifically structured and disposed to hold the valve button of the spray can in a depressed position in order to release the contents from the spray nozzle in the valve button without requiring the user to apply constant pressure on the valve button with his/her finger.

It is still a further object of the present invention to provide an adaptor for handheld spray cans, as set forth above, wherein the adaptor is universally structured for releasable attachment to a wide array of spray cans.

It is still a further object of the present invention to provide an adaptor for releasable attachment to handheld spray cans, as set forth above, and wherein the adaptor includes an actuator mechanism which is operable between an on position, to apply constant downward pressure on the depressible valve button of the spray can, and an off position to release the valve button when it is desired to interrupt spraying of the contents of the can.

It is still a further object of the present invention to provide an adaptor for releasable attachment to handheld spray cans, as set forth above, wherein the adaptor is inexpensive to manufacture and easy to use.

It is yet a further object of the present invention to provide an adaptor for releasable attachment to handheld spray cans, as set forth above, wherein the adaptor is easily removed and attached to spray cans, to permit reuse on a large number of spray cans.

These and other objects and advantages of the present invention are more readily apparent with reference to the accompanying drawings and detailed description.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
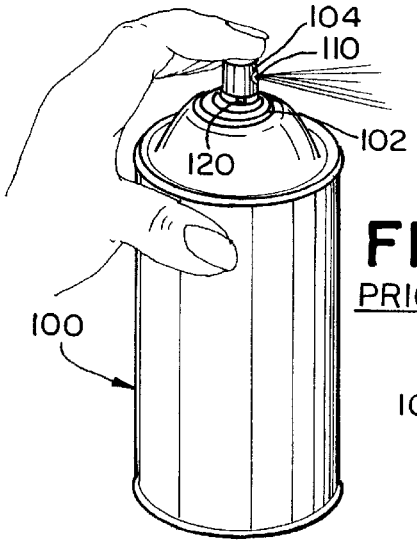
FIG.1 PRIOR ART
FIG. 1 is a top perspective view of a well known type of spray can in the prior art, such as a paint spray can, shown with a user's finger applying downward pressure on a depressible valve button of the spray can in order to open a valve and release the contents from the spray nozzle in the spray button outwardly in a particular spray pattern.

Referring initially to FIG. 1, a typical spray can, of the type which is well known in the prior art, is shown and is generally indicated as 100. The spray can 100 includes a top portion with a valve and spray nozzle assembly. Specifically, an annular rim 102 surrounds a tube 120 extending upwardly from a valve mechanism fitted within the top portion of the can. This well known design of the spray can valve and nozzle assembly further includes a button 104 fixed to the top of the tube 120. A nozzle 110 on the side face of the button 104 is disposed in fluid communication with the tube 120, as well as the internal valve and the contents within the spray can. Upon pressing down on the top of the button 104, the tube 120 is pushed down against the valve. This opens the valve and releases the contents of the can outwardly through the nozzle 110 in a sprayed pattern. Normally, downwardly pressure on the button 104 is done using the index finger, as seen in FIG. 1. Upon releasing pressure from the button 104, the valve closes to stop release of the contents.

Figure 2:
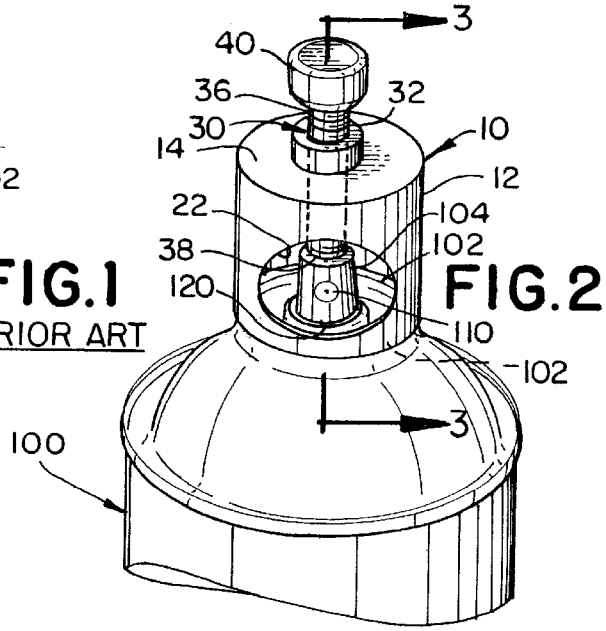
FIG. 2 is an isolated top perspective view showing a first preferred embodiment of the adaptor of the present invention installed on the top of a conventional spray can of the type shown in FIG. 1.
Figure 3A:
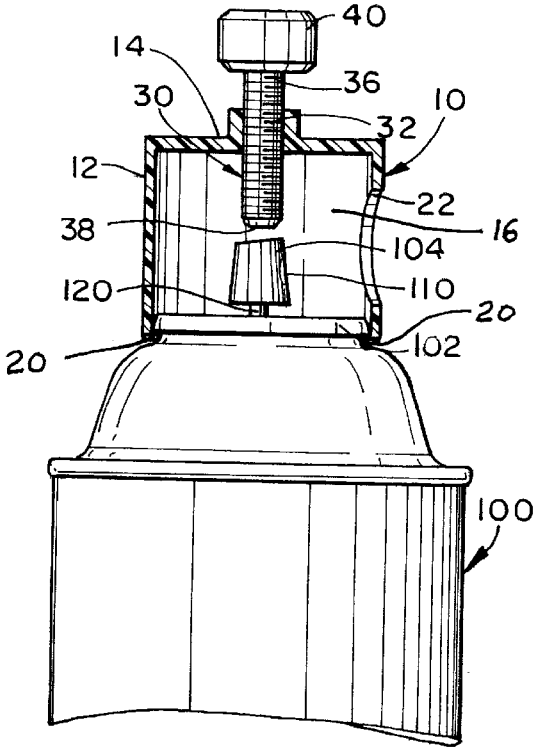
FIG. 3A is a cross-sectional view taken along the plane indicated by the arrows 3—3 in FIG. 2, with an actuator mechanism shown in an off position.
Figure 3B:
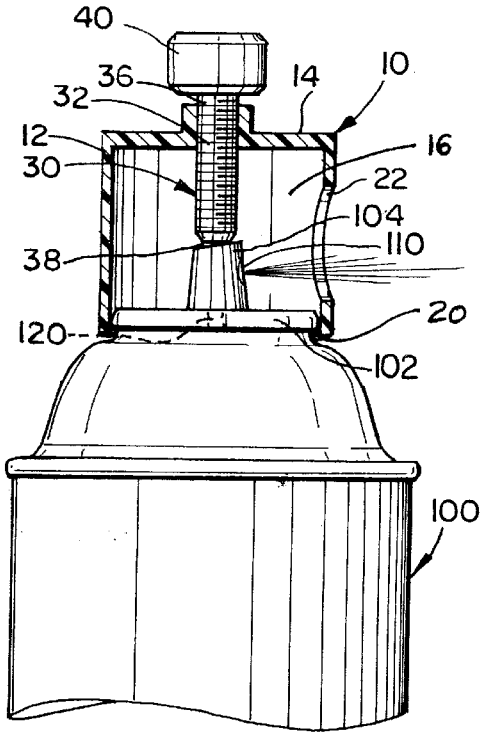
FIG. 3B is a cross-sectional view taken along the plane indicated by the arrows 3—3 in FIG. 2, wherein the actuator mechanism is shown in an on position in downward depressing engagement with the valve button of the spray can, thereby opening the valve and releasing the contents of the spray can from the spray nozzle.

Referring to FIGS. 2–3B, a first preferred embodiment of the adaptor of the present invention is shown, and is generally indicated as 10. The adaptor 10 is defined by a main body and includes a cylindrical side wall 12 and a top wall 14 surrounding a hollow interior 16. In the preferred embodiment, the main body resembles a cap which releasably attaches to the top of a spray can. The adaptor 10 or main body has an open bottom surrounded by a circumferential lip 20 which is structured and configured for releasable attachment to the annular rim 102 on the top of the spray can 100 (see FIGS. 3A and 3B). When attached to the spray can, the adaptor 10 surrounds the depressible valve button 104 of the spray can 100. An opening 22 is provided through the cylindrical side wall 12 for alignment with the nozzle 110 on the valve button 104 of the spray can 100 to thereby permit the contents of the spray can to be released from the nozzle and out through the opening 22 of the adaptor 10 without interference.

Figure 4:
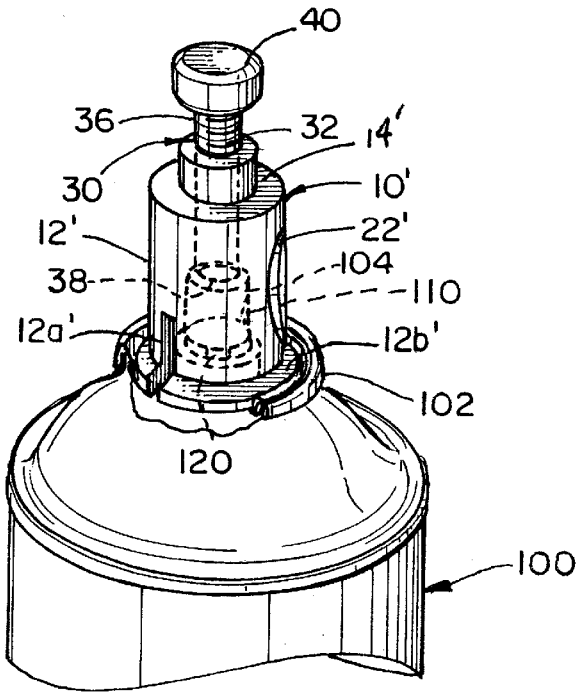
FIG. 4 is an isolated top perspective view showing a second preferred embodiment of the adaptor of the present invention installed on the top of a conventional spray can of the type shown in FIG. 1.

Referring to FIG. 4, a second preferred embodiment of the adaptor of the present invention is shown and is generally indicated as 10'. The adaptor 10' is similar to the adaptor 10 of the first embodiment and includes a cylindrical side wall 12' and a top wall 14'. However, instead of attaching about the outer surface of the annular rim 102 on the top of the spray can 100, the adaptor 10' is structured for releasable attachment on the inside of the annular rim 102. Specifically, the bottom end of the cylindrical side wall 12' is provided with an outwardly directed annular flange or skirt **12*b*'. The annular flange 12*b*' is specifically sized and configured for releasable engagement on the inner under side of the annular rim 102. Two or more spaced slots 12*a*' on the lower portion of the cylindrical side wall 12' extend through the annular flange 12*b*'. The slots 12*b*' permit slight compression of the lower end of the adaptor in order to reduce the overall outer circumference of the flange 12*b*' when inserting and removing the lower end of the adaptor, and particularly the flange, within the confines of the annular rim 102. Once the flange 12*b*' is seated below the annular rim 102, a squeezing or compressing force on the outer surface of the cylindrical side wall 12*b*' can be released to thereby cause the annular flange 12*b*' to return to a relaxed state. The circumference of the flange 12*b*' is specifically sized to capture the flange below the annular rim 102 so that, when in the relaxed state, the adaptor cannot be lifted and separated from the top of the can. Specifically, the outer circumference of the flange 12*b*' is slightly greater than the innermost circumference of the annular rim 102. Therefore, when the flange 12*b*' is seated below the annular rim 102, it is not possible to pull the annular flange upwardly and through the rim 102 without first compressing the lower portion of the cylindrical side wall 12' in order to temporarily reduce the circumference of the flange 12*b*' to a size that allows the flange to pass through the inner circumference of the rim 102**.

An actuator member 30 is provided on the adaptor for operating the valve button 104 of the spray can 100. In the embodiments shown in FIGS. 2–4, the actuator member includes a threaded elongate stem 32 which is threadably received through the top wall 14, 14' of the adaptor 10, 10' so that a proximal end 36 is maintained above the top wall and a distal end 38 is positioned and disposed below the top wall and within the hollow interior 16 of the adaptor. The actuator member 30 is positioned and disposed in direct alignment above the top of the valve button so that upon downward threaded advancement of the elongate stem 32 through the top wall, the distal end eventually contacts the top of the valve button 104. To facilitate threaded advancement and retreat of the elongate stem 32 relative to the top wall 14, 14' and the valve button 104 of the spray can, a knob 40 is provided on the proximal end. By rotating the knob 40 in the clockwise direction, the threaded stem 32 is caused to advance downwardly towards the valve button 104. After the distal end 38 contacts the top of the valve button 104, continued downward advancement causes the valve button of the spray can to be depressed, thereby opening a valve within the spray can and releasing the contents through the tube 120 and out from the nozzle 110 on the valve button.

In both of these embodiments of the adaptor (10 and 10'), as described above, the threaded stem 32 serves as a means to hold the actuator mechanism 30 in a fixed position, thereby enabling the valve button 104 to be held at both the open, depressed position and the closed, raised position. When it is desired to release the actuator mechanism 30, to close the spray can valve and interrupt (stop) spraying, the knob 40 is rotated in the counter-clockwise direction to retract the threaded stem 32 upwardly so that the distal end 38 releases from the top of the valve button 104.

Figure 5A:
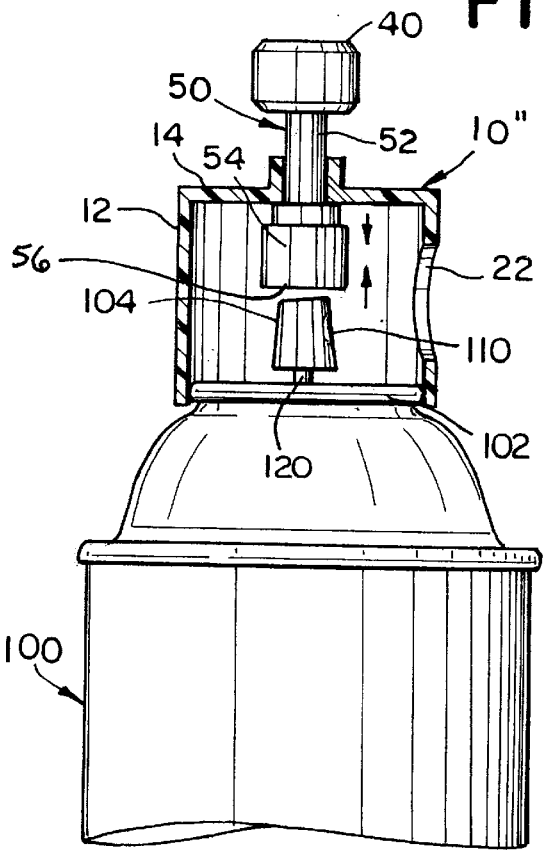
FIG. 5A is a cross-sectional view of yet another embodiment of the adaptor shown attached to the top of a conventional spray can, wherein a spring loaded actuator mechanism on the adaptor is shown in an off position.
Figure 5B:
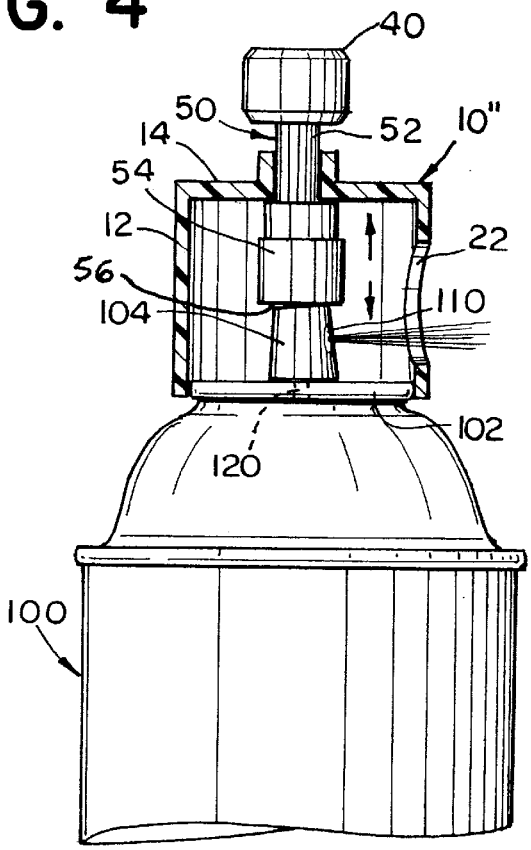
FIG. 5B is a cross-sectional view of the adaptor of the embodiment of FIG. 5A shown attached to a conventional spray can, with the spring loaded actuator mechanism shown in an on position in downwardly depressing engagement with the valve button of the spray can, thereby opening the valve of the spray can and releasing the can's contents from the spray nozzle.

The present invention contemplates use of other actuator mechanisms to be used in conjunction with the cylindrical shaped bodies of the adaptors 10 and 10' described above. For instance, an actuator 50 having a stem 52 and a spring loaded mechanism 54 is shown fitted to the adaptor 10" in FIGS. 5A and 5B. The adaptor 10" has the same cylindrical housing as the adaptor of the first preferred embodiment shown and described in connection with FIGS. 2–3B. The spring loaded mechanism 54 is operable between an off position (see FIG. 5A), wherein the elongate actuator member 52 is retracted upwardly so that the distal end 56 releases the valve button 104, and an on position (see FIG. 5B), wherein the bottom distal end 56 of the actuator is forced into downwardly depressing engagement with the valve button 104 to thereby release the contents in a sprayed pattern from the nozzle 110.

It is further contemplated that the structure of the adaptor may be altered. For instance, the cylindrical side wall and top wall may be replaced with a brace, bridge, or other device which clips to the top of the can in order to position and maintain an actuator member in position for operating the valve button of the spray can between the on and off position.

While the instant invention has been shown and described in accordance with preferred and practical embodiments thereof, it is recognized that departures from the instant disclosure are contemplated within the spirit and scope of the present invention as defined in the following claims and as interpreted under the doctrine of equivalents.

What is claimed is:

1. A device for attachment to a spray can having a top end with an annular rim on the top end, and the annular rim surrounding a valve mechanism including a valve button and a nozzle, wherein contents of the spray can are released from the nozzle upon applying downward pressure on the valve button, said device comprising:

a main body including a top portion and a bottom portion, said bottom portion being structured and disposed for releasable attachment to the annular rim on the top of the spray can to support and maintain the device on the top of the spray can with said top portion of said main body positioned and disposed above the valve button;

an actuator assembly on said main body and selectively operable, by application of an external force, between an on position, defined by said actuator assembly applying downward pressure on the valve button of the spray can to cause release of the contents from the nozzle, and an off position, defined by said actuator assembly released from applying downward pressure on the valve button so that release of the contents of the spray can from the nozzle is stopped, and said actuator assembly being structured and disposed to selectively remain in said on position, to continue release of the contents from the nozzle, upon removal of the external force.

2. The device as recited in claim 1, wherein said bottom portion of said main body comprises a flanged edge structured and disposed for releasable attachment under the annular rim on the top of the spray can to releasably secure the device on the top of the spray can.

3. The device as recited in claim 2 wherein the flanged edge of said bottom portion of said main body is structured and disposed for releasable attachment with an outer portion of the underside of the annular rim on the top of the spray can.

4. The device as recited in claim 2 wherein said flanged edge of said bottom portion of said main body is structured and disposed for releasable attachment with an inner portion of the underside of the annular rim on the top of the spray can.

5. A device for attachment to a spray can having a top end with an annular rim on the top end, and the annular rim surrounding a valve mechanism including a valve button and a nozzle, wherein contents of the spray can are released from the nozzle upon applying downward pressure on the valve button, said device comprising:

a main body including a cylindrical side wall, a top end, an open bottom, and an opening formed through said cylindrical side wall for alignment with the nozzle to permit release of the sprayed contents outwardly therethrough, and a circumferential lip formed about said open bottom of said cylindrical side wall, said circumferential lip being structured and disposed for releasable attachment to the annular rim on the top of the spray can to support and maintain the device on the top of the spray can with said top end positioned and disposed above the valve button;

an actuator assembly on said main body and selectively operable, by application of an external force, between an on position, defined by said actuator assembly applying downward pressure on the valve button of the spray can to cause release of the contents from the nozzle, and an off position, defined by said actuator assembly released from applying downward pressure on the valve button so that release of the contents of the spray can from the nozzle is stopped, and said actuator assembly being structured and disposed to selectively remain in said on position, to continue release of the contents from the nozzle, upon removal of the external force.

6. The device as recited in claim 5 wherein said circumferential lip formed about said open bottom of said cylindrical side wall is structured and disposed for releasable engagement under the annular rim on the top of the spray can to releasably secure the device on the top of the spray can.

7. The device as recited in claim 6 wherein said circumferential lip is structured and disposed for engagement about an outer portion of the underside of the annular rim on the top of the spray can.

8. The device as recited in claim 7 wherein said circumferential lip is structured and disposed to flex outwardly from a normally relaxed state in order to facilitate passage of said circumferential lip over said annular rim on the top of the spray can, thereby facilitating attachment and separation of the device from the top of the spray can.

9. The device as recited in claim 6 wherein said circumferential lip is structured and disposed for releasable engagement about an inner portion of the underside of the annular rim on the top of the spray can.

10. The device as recited in claim 9 wherein said circumferential lip is structured and disposed to flex inwardly from a normally relaxed state in order to facilitate passage of said circumferential lip through the annular rim of the spray can, on an inner side thereof, thereby facilitating attachment and separation of the device from the top of the spray can.

11. A device for attachment to a spray can having a top end with an annular rim on the top end, and the annular rim surrounding a valve mechanism including a valve button and a nozzle, wherein contents of the spray can are released from the nozzle upon applying downward pressure on the valve button, said device comprising:

a main body including a cylindrical side wall, a top end, an open bottom, and an opening formed through said cylindrical side wall for alignment with the nozzle to permit release of the sprayed contents outwardly therethrough, and a circumferential lip formed about said open bottom of said cylindrical side wall, said circumferential lip being structured and disposed for releasable attachment to the annular rim on the top of the spray can to support and maintain the device on the top of the spray can with said top end positioned and disposed above the valve button;

an actuator assembly on said top end of said main body and including:

an elongate stem having a proximal end and a distal end;

means for moving said stem between an on position, defined by said distal end engaging and applying downward pressure on the valve button of the spray can to cause release of the contents from the nozzle, and an off position, defined by said distal being released from applying downward pressure on said valve button so that release of the contents of the spray can from the nozzle is stopped, and said actuator assembly being structured and disposed to selectively maintain the stem in both the off position and the on position.

12. The device as recited in claim 11 wherein said circumferential lip on said open bottom of said cylindrical wall is structured and disposed for releasable engagement under the annular rim on the top of the spray can to releasably secure the device on the top of the spray can.

13. The device as recited in claim 12 wherein said circumferential lip is structured and disposed for engagement about an outer portion of the underside of the annular rim on the top of the spray can.

14. The device as recited in claim 13 wherein said circumferential lip is structured and disposed to flex outwardly from a normally relaxed state in order to facilitate passage of said circumferential lip over said annular rim on the top of the spray can, thereby facilitating attachment and separation of the device from the top of the spray can.

15. The device as recited in claim 12 wherein said circumferential lip is structured and disposed for releasable engagement about an inner portion of the underside of the annular rim on the top of the spray can.

16. The device as recited in claim 15 wherein said circumferential lip is structured and disposed to flex inwardly from a normally relaxed state in order to facilitate passage of said circumferential lip through the annular rim of the spray can, on an inner side thereof, thereby facilitating attachment and separation of the device from the top of the spray can.

17. The device as recited in claim 11 wherein said elongate stem of said actuator assembly and said main body include cooperating thread means for threaded advancement and withdrawal of said stem relative to said top end of said main body, thereby allowing said actuator assembly to be selectively operated and maintained in both the off position and the on position.

18. The device as recited in claim 11 wherein said actuator assembly comprises a spring-loaded mechanism fitted to said stem and structured and disposed to releasably lock said stem in both the off position and the on position.

* * * * *